US007410544B2

(12) United States Patent
Garcia et al.

(10) Patent No.: US 7,410,544 B2
(45) Date of Patent: Aug. 12, 2008

(54) METHOD FOR CLEANING ELECTROLESS PROCESS TANK

(75) Inventors: Sam S. Garcia, Austin, TX (US); Edward Acosta, Martindale, TX (US); Varughese Mathew, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 11/408,311

(22) Filed: Apr. 21, 2006

(65) Prior Publication Data

US 2007/0246075 A1 Oct. 25, 2007

(51) Int. Cl.
*B08B 3/04* (2006.01)

(52) U.S. Cl. ..... 134/26; 134/22.1; 134/22.11; 134/22.14; 134/22.17; 134/22.19; 134/27; 134/28; 134/29; 134/34; 134/36; 134/41; 134/42; 134/166 C

(58) Field of Classification Search ..... 134/22.1, 134/22.11, 22.14, 22.17, 22.19, 26, 27, 28, 134/29, 34, 36, 41, 42, 166 C; 427/230, 427/235, 239, 343
See application file for complete search history.

(56) References Cited

U.S. PATENT DOCUMENTS

| | | | | |
|---|---|---|---|---|
| 2,200,486 | A * | 5/1940 | Burdick | 252/79.2 |
| 3,057,764 | A * | 10/1962 | La Boda et al. | 216/53 |
| 3,104,167 | A * | 9/1963 | Cotteta | 216/109 |
| 4,143,618 | A * | 3/1979 | Del Vecchio | 118/603 |
| 4,302,246 | A * | 11/1981 | Brindisi et al. | 75/715 |
| 4,554,049 | A * | 11/1985 | Bastenbeck | 216/108 |
| 4,692,252 | A * | 9/1987 | Atwood et al. | 210/761 |
| 5,601,657 | A * | 2/1997 | Baum | 134/3 |
| 5,679,170 | A * | 10/1997 | Frenier | 134/3 |
| 6,332,970 | B1 * | 12/2001 | Coffey | 205/720 |
| 6,341,612 | B1 * | 1/2002 | Duckett et al. | 134/95.1 |
| 6,562,145 | B2 * | 5/2003 | Duckett et al. | 134/27 |
| 6,770,150 | B1 * | 8/2004 | Duckett et al. | 134/29 |
| 6,924,232 | B2 | 8/2005 | Mathew et al. | |
| 2002/0078975 | A1 * | 6/2002 | Rowe | 134/3 |
| 2004/0146620 | A1 * | 7/2004 | Iwashita et al. | 426/521 |
| 2004/0182425 | A1 * | 9/2004 | Kravitz et al. | 134/26 |
| 2005/0045209 | A1 | 3/2005 | Tan | |
| 2005/0183744 | A1 * | 8/2005 | Staub et al. | 134/22.1 |
| 2005/0217705 | A1 * | 10/2005 | Zuck | 134/22.1 |
| 2005/0236017 | A1 * | 10/2005 | Kravitz et al. | 134/22.1 |
| 2006/0024514 | A1 * | 2/2006 | McComas | 428/457 |

FOREIGN PATENT DOCUMENTS

| | | | |
|---|---|---|---|
| JP | 57035675 | * | 2/1982 |
| JP | 08266875 | * | 10/1996 |
| JP | 11229176 | * | 8/1999 |

* cited by examiner

*Primary Examiner*—Sharidan Carrillo
(74) *Attorney, Agent, or Firm*—John A. Fortkort; Fortkort & Houston P.C.

(57) ABSTRACT

A method for cleaning a metal plating tank is provided herein. In accordance with the method, the tank is exposed to a first acid (103), after which the tank is exposed to a second acid in the presence of a first oxidizing agent (107).

19 Claims, 3 Drawing Sheets

METHOD FOR CLEANING ELECTROLESS PROCESS TANK

FIELD OF THE DISCLOSURE

The present disclosure relates generally to electroless plating, and more particularly to a method for removing metal contaminants from the process tanks utilized in electroless plating.

BACKGROUND OF THE DISCLOSURE

The use of copper interconnect technology has become widespread in the semiconductor industry, due to the increased circuit speed copper provides compared to older technologies. At the same time, the use of lower capacitance dielectric materials, commonly referred to in the art as low dielectric constant or "low k" materials, has become more common to provide insulation around the interconnect wiring of semiconductor devices. While the use of interconnect materials such as copper allows signals to travel faster through a device, the use of low-k materials decreases the capacitance factor of the dielectric material surrounding the interconnect. This further increases the speed at which signals can travel across the interconnect, because the signals have less interference with each other.

It is well known that copper has a much more pronounced tendency to diffuse into dielectric materials than older interconnect materials such as aluminum. This tendency degrades the dielectric constant of dielectric materials. Hence, in order to integrate the use of copper with dielectric materials, barrier films such as Ta, TaN and the like are used around the interconnect to prevent the diffusion of copper into the surrounding dielectric materials. Materials such as CoWB and CoWP are used to cap copper for similar reasons and also to enhance device reliability by increasing electromigration resistance. In the formation of these types of barrier films, a very selective deposition of the barrier films is required.

Electroless deposition has emerged as a desirable process for forming doped cobalt barrier films. In addition to having the requisite selectivity, certain electroless films such as CoWB do not require catalytic activation for deposition processes, and may be implemented at sufficiently low temperatures. A description of the use of an electroless deposition process in forming barrier films may be found in commonly assigned U.S. Pat. No. 6,924,232 (Mathew et al.).

Despite the significant advantages of the electroless process in forming doped cobalt barrier films, the commercial implementation of this process is beset by certain challenges. In particular, in practice, it is frequently found that the plating bath life in the electroless process is much shorter than should theoretically be the case. This necessitates frequent bath replacement and costly interruptions to the semiconductor fabrication process, and is also undesirable from an environmental perspective.

There is thus a need in the art for an electroless plating process that overcomes the aforementioned infirmities. In particular, there is a need in the art for a method for implementing an electroless plating process that provides for a longer bath life. These and other needs may be met by the devices and methodologies described herein.

DETAILED DESCRIPTION

Figure 1:
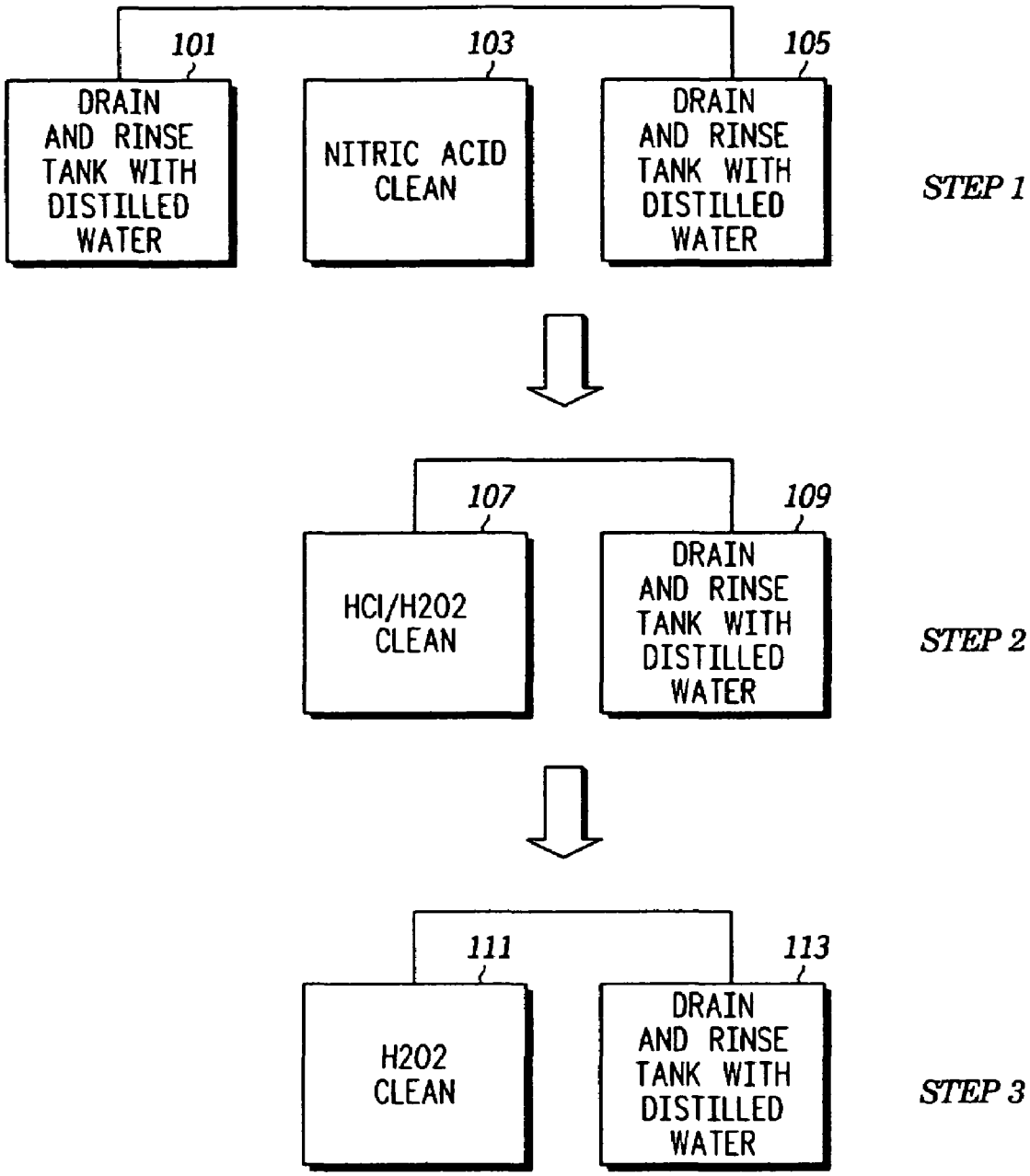
FIG. 1 is a flowchart of one embodiment of a process in accordance with the teachings herein.

In one aspect, a method for cleaning a tank, such as a metal plating tank used for plating metals and alloys, is provided herein. In accordance with the method, the tank is exposed to a first acid, after which the tank is exposed to a second acid in the presence of a first oxidizing agent.

In another aspect, a method for cleaning a tank, such as a metal plating tank used for plating metals and alloys, or for cleaning the components of a metal plating system, is provided. In accordance with the method, the tank or components are exposed to a first aqueous rinse, after which the tank or components are exposed to a first acid. The tank or components are then exposed to a second acid in the presence of a first oxidizing agent, after which the tank or components are subjected to a second aqueous rinse. The tank or components are then exposed to a second oxidizing agent.

In a further aspect, a method for cleaning a tank, such as a metal plating tank used for plating metals and alloys, is provided herein. In accordance with the method, the tank is subjected to a first aqueous rinse, and is then exposed to a first solution comprising nitric acid. The tank is then subjected to a second aqueous rinse, after which it is exposed to a second solution comprising hydrochloric acid and hydrogen peroxide. The tank is then subjected to a third aqueous rinse, after which it is exposed to a third solution comprising hydrogen peroxide. Finally, the tank is subjected to a fourth aqueous rinse.

These and other aspects of the present disclosure are described in greater detail below.

As used herein, the term "metal plating tank" refers to a tank used for plating metals and alloys.

It has now been found that the aforementioned problem with reduced plating bath lifetimes arises, at least in part, from the presence of metal contaminants in plating tanks. In particular, it has been found that electroless plating bath life is significantly reduced when plating tanks are contaminated with even very small amounts (e.g., parts per million) of metal contaminants. Without wishing to be bound by theory, it is believed that this is due to the use in plating baths of highly reactive reducing agents, such as boranes, which can decompose very rapidly, and in some cases instantaneously, if even small amounts (e.g., parts per million) of metal contaminants are present in the bath. Hence, in order to achieve extended bath life, it is very important to remove such contaminants from the surfaces of a plating tank and its components, including pumps and filters.

It has further been found that such metal contaminants may be reduced to suitable levels by exposing the tank and its components (such as pumps and filters) to a first acid such as nitric acid ($HNO_3$), and then exposing the tank and its components to a second acid, such as hydrochloric acid (HCl), in the presence of a first oxidizing agent such as hydrogen peroxide ($H_2O_2$). Preferably, this is followed by exposure of the tank and its components to a second oxidizing agent, which may be the same as, or different from, the first oxidizing agent.

FIG. 1 illustrates a first particular, non-limiting embodiment of a method of this type which may be utilized to remove metal contaminants. The method depicted therein is a three step process which is preferably employed shortly before the plating tank is charged with the plating solution.

In the first step, the tank is completely drained of old plating solution, and is subjected to a first aqueous rinse. Preferably, the first aqueous rinse includes thoroughly rinsing the tank with distilled water 101. This may be accomplished, for example, by filling the tank with distilled water, circulating the water for about 5 to 10 minutes, draining the tank, and repeating this cycle 2 to 3 times. In some embodiments, the aqueous rinse may be preceded by rinsing the tank with various solvents or detergents.

The tank is then subjected to a nitric acid clean 103. Preferably, this involves exposing the surfaces of the tank (especially those surfaces which come into contact with the plating solution) to an aqueous solution of nitric acid. This may be accomplished, for example, by filling the tank approximately half way with distilled water, and then slowly adding concentrated nitric acid to the distilled water with mixing. The mixing is preferably accomplished by running the pump system of the tank so that metal contaminants will also be removed from the pump and filter surfaces. A sufficient amount of additional distilled water is then added to completely fill the tank, after which the temperature of the tank solution is slowly increased to about 40° C. to about 45° C. and the solution is circulated for about 30 to about 45 minutes. This procedure is preferably implemented in a fume hood or with other provisions to remove the vapors generated. The solution may be circulated for a shorter or longer period of time depending on such factors as the amount of metal contaminants trapped in the tank filter and the time elapsed since the last cleaning.

The nitric acid used in this step is preferably about 70% by weight $HNO_3$ (about 15.3 M). The nitric acid is typically added at a volume ratio (nitric acid to tank volume) within the range of about 100:1000 to about 1000:1000, preferably at a volume ratio within the range of about 100:1000 to about 800:1000, more preferably at a volume ratio within the range of about 200:1000 to about 600:1000, and most preferably at a volume ratio of about 600:1000. After the nitric acid clean 103, the tank is drained.

The tank is then filled with distilled water 105, and the water is circulated. This process is repeated 2 to 3 times to ensure complete removal of the nitric acid from the tank and all of its components.

Next, the tank is cleaned with a mixture of hydrochloric acid (HCl) in hydrogen peroxide ($H_2O_2$) 107. Preferably, this involves exposing the surfaces of the tank (especially those surfaces which come into contact with the plating solution) to an aqueous solution of $HCl/H_2O_2$. This may be accomplished by filling the tank partially with distilled water, and then slowly adding the HCl to the distilled water with mixing. After the mixture has been allowed to circulate for about 10 minutes, the $H_2O_2$ is added slowly to the solution, and the solution is mixed well. The mixing in both cases is preferably accomplished by running the pump system of the tank so that metal contaminants will also be removed from the pump and filter surfaces.

A sufficient amount of additional distilled water is then added to completely fill the tank, after which the temperature of the tank solution is slowly increased to about 45° C. and the solution is circulated for about 30 to about 60 minutes. This procedure is preferably implemented in a fume hood or with other suitable provisions to remove the vapors generated, which may include chlorine gas. The solution may be circulated for a shorter or longer period of time depending on such factors as the amount of metal contaminants trapped in the tank filter.

The hydrochloric acid used in this step is preferably about 38% by weight HCl (about 12 M). The hydrochloric acid is typically added at a volume ratio (hydrochloric acid to tank volume) within the range of about 50:1000 to about 500:1000, preferably at a volume ratio within the range of about 100:1000 to about 400:1000, more preferably at a volume ratio within the range of about 150:1000 to about 300:1000, and most preferably at a volume ratio of about 150:1000 to about 200:1000. The hydrogen peroxide used in this step is preferably about 30% by weight $H_2O_2$, and is typically added at a volume ratio (hydrogen peroxide to tank volume) within the range of about 1:1000 to about 800:1000, preferably at a volume ratio within the range of about 10:1000 to about 400:1000, more preferably at a volume ratio within the range of about 25:1000 to about 200:1000, and most preferably at a volume ratio of about 50:1000 to about 100:1000.

The tank is then drained and is filled with distilled water 109, and the water is circulated. This process is repeated 3 to 4 times to ensure complete removal of the $HCl/H_2O_2$ mixture from the tank and all of its components.

Next, the tank is subjected to an $H_2O_2$ clean 111. Preferably, this involves exposing the surfaces of the tank (especially those surfaces which come into contact with the plating solution) to an aqueous solution of $H_2O_2$. This may be accomplished by filling the tank partially with distilled water, and then slowly adding the $H_2O_2$ to the distilled water with mixing. The mixing is preferably accomplished by running the pump system of the tank so that metal contaminants will also be removed from the pump and filter surfaces. A sufficient amount of additional distilled water is then added to completely fill the tank, after which the temperature of the tank solution is slowly increased to about 40° C. to about 45° C. and the solution is circulated for about 60 minutes. This procedure is preferably implemented in a fume hood or with other provisions to remove the vapors generated. The solution may be circulated for a shorter or longer period of time depending on such factors as the amount of metal contaminants trapped in the tank filter.

The hydrogen peroxide used in this step is preferably about 30% by weight $H_2O_2$, and is typically added at a volume ratio (hydrogen peroxide to tank volume) within the range of about 100:1000 to about 800:1000, preferably at a volume ratio within the range of about 200:1000 to about 600:1000, more preferably at a volume ratio within the range of about 300:1000 to about 500:1000, and most preferably at a volume ratio of about 400:1000. The tank is then drained.

Next, the tank is filled with distilled water 113, and the water is circulated for about 10 minutes. This process is repeated until the pH of the rinse water is neutral to ensure complete removal of any acidic or alkaline residues and $H_2O_2$ from the tank and all of its components.

The aforementioned process has a number of advantages. First of all, it may be performed in situ. Hence, it does not require that the plating tank or any of its components, including the filter and pump, be disassembled.

Moreover, each of the three steps of this process addresses unique problems. Thus, step 1 of the process is effective at removing relatively large amounts of deposited metals from the plating tank and its components, including the filter and pump. This is important, since relatively large amounts of metal deposits may form as the plating bath ages, especially in the plating tank filter. The second step is effective at reducing the concentrations of most metal contaminants to the parts per billion (ppb) range, although a few metal contaminants remain at the parts per million (ppm) level. The third step reduces the level of the remaining contaminants to the parts per billion (ppb) range, which is below, or near, the detection level of detectors commonly used in the art. This process extends the life of the plating bath, especially when used in conjunction with highly reactive reducing agents such as boranes, and makes the electroless plating process itself more manufacturable.

FIGS. 2-5 (and the data set forth in TABLE 1 below) illustrate the efficacy of the methodology disclosed herein in removing metal contaminants from plating tanks, and in particular, plating tanks associated with an electroless CoWB plating process. These figures show the concentration or level (in ppm) of the indicated contaminant metals in the tank at each step of the process described herein. In each step, the concentration of contaminant metallic ions after that step was determined by draining the plating tank, refilling the tank with distilled water, recirculating the water for 5 to 10 minutes, collecting samples of the water, and determining ion concentrations in the samples. Hence, the recited concentrations represent the concentrations of metal ions extracted by the distilled water, but do not represent the absolute concentration of metal ions extracted by the preceding cleaning step.

Figure 2:
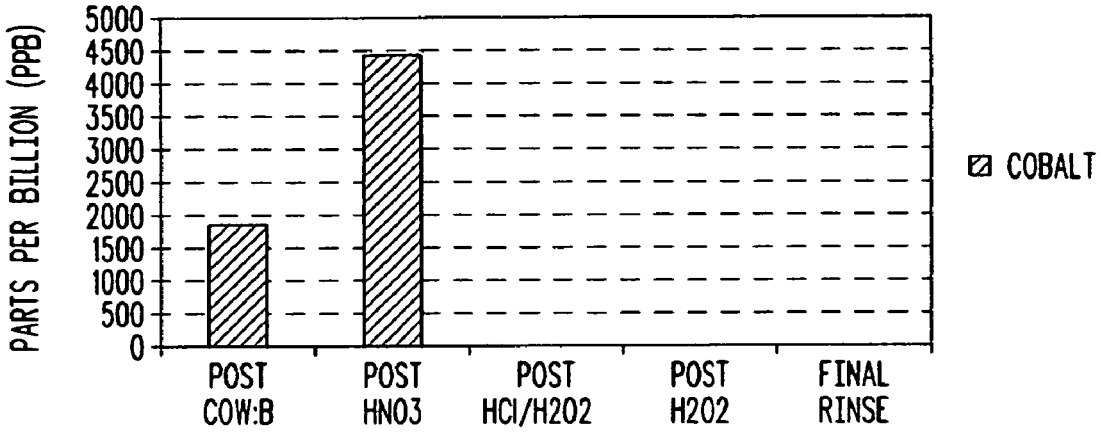
FIG. 2 is a graph showing the residual concentration of cobalt present in the plating tank after each of the steps in the process depicted in FIG. 1.

Thus, with respect to FIG. 2, there are approximately 1900 ppm of cobalt after the plating step (denoted CoW:B), and almost 4500 after the nitric acid clean (the increase in cobalt concentration here is likely due to removal of cobalt particles and deposits from the tank filtration system). The level of cobalt dips below measurable levels after the $HCl/H_2O_2$ clean.

Figure 3:
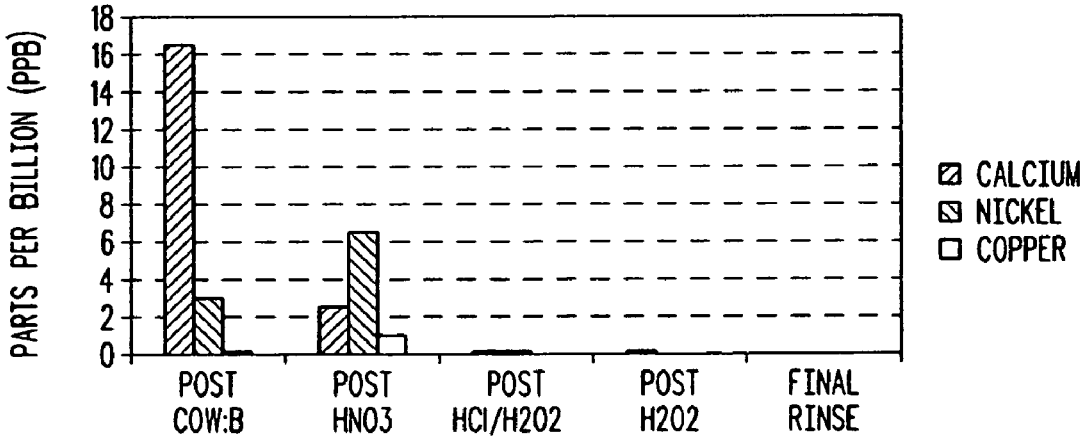
FIG. 3 is a graph showing the residual concentration of calcium, nickel and copper present in the plating tank after each of the steps in the process depicted in FIG. 1.

Similar results are observed in FIG. 3. Thus, the concentration of calcium in the plating tank is about 16 ppm after plating, and the amount of nickel is about 3 ppm after plating, while the concentration of copper is below measurable levels at this point in the process. After the nitric acid clean, the levels of calcium and nickel contaminants drops to 2 ppm and 6 ppm, respectively, while the level of copper contaminants rises to about 1 ppm. After the $HCl/H_2O_2$ clean, the level of all three contaminants drops below measurable levels.

Figure 4:
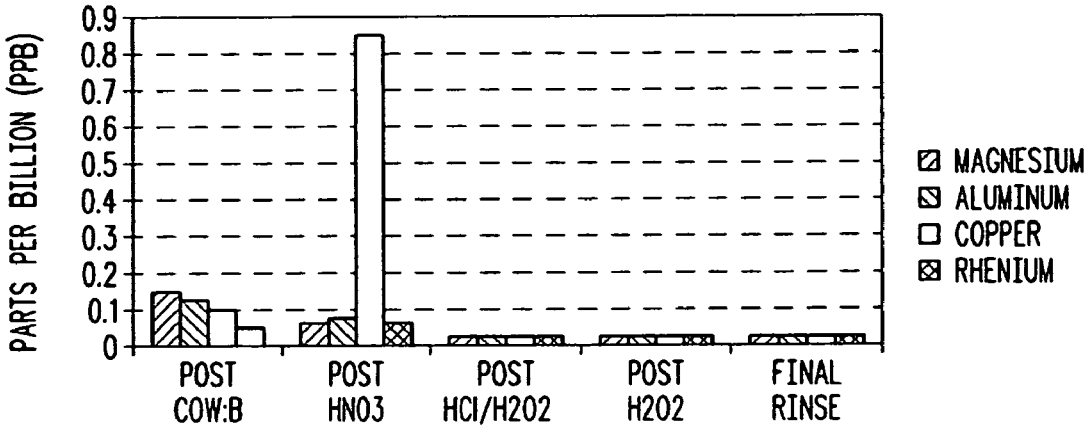
FIG. 4 is a graph showing the residual concentration of magnesium, aluminum, copper and rhenium present in the plating tank after each of the steps in the process depicted in FIG. 1.

As shown in FIG. 4, the concentration of magnesium, aluminum, copper and rhenium in the plating tank after plating are about 0.15 ppm, 0.11 ppm, 0.1 ppm and 0.05 ppm, respectively. These amounts change to 0.07 ppm, 0.08 ppm, 0.85 ppm and 0.08 ppm, respectively, after the nitric acid clean. After the $HCl/H_2O_2$ clean, the level of all four contaminants drops below about 0.02 ppm. Note that the concentration of copper differs slightly in the graph of FIG. 4 compared to the graph of FIG. 3, since the data comes from different plating baths.

Figure 5:
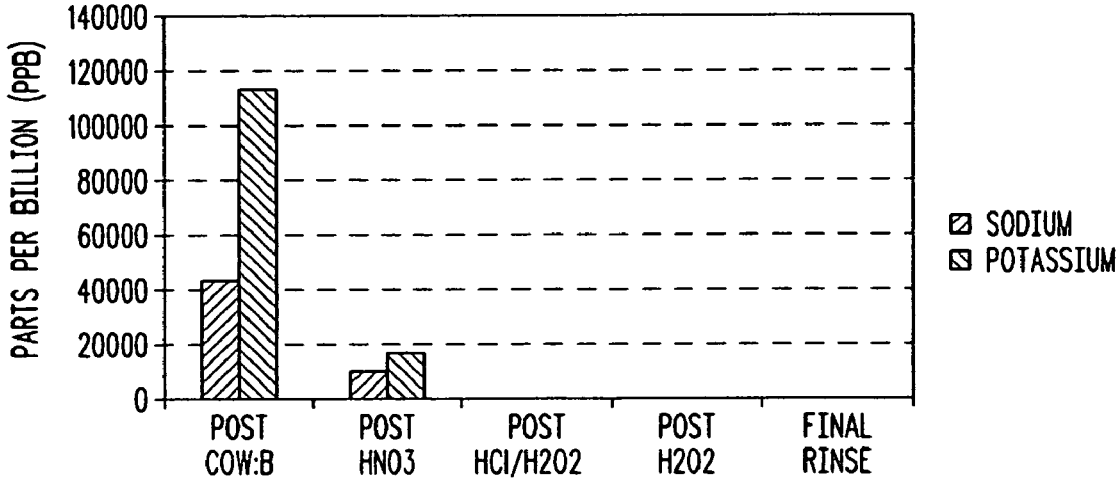
FIG. 5 is a graph showing the residual concentration of sodium and potassium present in the plating tank after each of the steps in the process depicted in FIG. 1.

As shown in FIG. 5, the concentration of sodium in the plating tank is about 40,000 ppm after plating, and the amount of potassium is about 116,000 ppm after plating. After the nitric acid clean, the levels of sodium and potassium contaminants drops to about 10,000 ppm and 8,000 ppm, respectively. After the $HCl/H_2O_2$ clean, the level of all three contaminants drops below measurable levels.

It will be appreciated from the foregoing that significant removal of metal contaminants occurs even after the $HCl/H_2O_2$ clean. Hence, in some embodiments, the process may be terminated at this point. However, the additional treatment with $H_2O_2$ and the additional rinses are effective at removing most metal contaminants below levels measurable on detectors commonly used in the art, so that the concentration of these contaminants is in the parts per billion (ppb) range or less. This fact may be appreciated with respect to TABLE 1 below.

TABLE 1

Metal Contaminant Concentrations (in PPM)

| Metal | Post CoW:B | Post $HNO_3$ | Post $HCl/H_2O_2$ | Post $H_2O_2$ | Final Rinse |
|---|---|---|---|---|---|
| Lithium | 0.025 | 0.025 | 0.025 | 0.025 | 0.025 |
| Sodium | 44100 | 8866 | 18.67 | 3.223 | 0.297 |
| Magnesium | 0.162 | 0.066 | 0.025 | 0.025 | 0.025 |
| Aluminum | 0.117 | 0.077 | 0.025 | 0.025 | 0.025 |
| Potassium | 115000 | 18500 | 44.52 | 7.127 | 0.679 |
| Calcium | 16.76 | 2.594 | 0.1 | 0.111 | 0.025 |
| Titanium | 0.291 | 0.083 | 0.025 | 0.025 | 0.058 |
| Chromium | 0.025 | 0.025 | 0.025 | 0.025 | 0.025 |
| Manganese | 0.025 | 0.025 | 0.025 | 0.025 | 0.025 |
| Iron | 0.025 | 0.285 | 0.025 | 0.025 | 0.025 |
| Cobalt | 1838 | 4388 | 34.26 | 0.691 | 0.025 |
| Nickel | 3.082 | 6.561 | 0.107 | 0.025 | 0.025 |
| Copper | 0.1 | 0.857 | 0.025 | 0.025 | 0.025 |
| Zinc | 0.023 | 0.025 | 0.025 | 0.025 | 0.025 |
| Gallium | 0.025 | 0.025 | 0.025 | 0.025 | 0.025 |
| Germanium | 0.025 | 0.025 | 0.025 | 0.025 | 0.025 |
| Arsenic | 0.271 | 1.016 | 3.406 | 0.025 | 0.025 |
| Yttrium | 0.025 | 0.025 | 0.025 | 0.025 | 0.025 |
| Zirconium | 0.025 | 0.025 | 0.025 | 0.025 | 0.025 |
| Niobium | 0.026 | 0.03 | 0.025 | 0.025 | 0.025 |
| Molybdenum | 0.025 | 0.038 | 0.025 | 0.025 | 0.025 |
| Indium | 0.025 | 0.025 | 0.025 | 0.025 | 0.025 |
| Tin | 0.025 | 0.025 | 0.025 | 0.025 | 0.025 |
| Antimony | 0.025 | 0.025 | 0.025 | 0.025 | 0.025 |
| Barium | 0.025 | 0.025 | 0.025 | 0.025 | 0.025 |
| Hafnium | 0.025 | 0.025 | 0.025 | 0.025 | 0.025 |
| Tantalum | 0.025 | 0.025 | 0.025 | 0.025 | 0.025 |
| Tungsten | 8426 | 10000 | 42.76 | 5.263 | 0.025 |
| Rhenium | 0.042 | 0.061 | 0.025 | 0.025 | 0.025 |
| Iridium | 0.026 | 0.025 | 0.025 | 0.025 | 0.025 |
| Bismuth | 0.034 | 0.025 | 0.254 | 0.025 | 0.025 |

As seen from the data in TABLE 1, after the $HCl/H_2O_2$ clean, the concentration of most metal contaminants is below 0.025 ppm, which is the detection limit of the detector used in collecting the data. However, measurable levels of sodium, potassium, calcium, cobalt, arsenic, tungsten and bismuth remain after this step. The subsequent step (that is, the $H_2O_2$ clean) reduces the concentrations of arsenic and bismuth below measurable levels, and significantly reduces the concentrations of the remaining detectable metals (namely sodium, potassium, calcium, cobalt, and tungsten). The final rinse reduces the concentrations of calcium, cobalt and tungsten below measurable levels, and significantly reduces the concentrations of sodium and potassium, the only two remaining metals that are present at detectable concentrations. Of course, it will be appreciated that the remaining concentrations of even these two metals are only slightly above detectable limits. At these concentrations, now in the ppb range, these metals do not interfere with the electroless plating process to any significant extent.

One skilled in the art will appreciate that various modifications and substitutions may be made in the processes described herein. Thus, for example, while $H_2O_2$ is the preferred oxidizing agent, other oxidizing agents as are known to the art may be utilized in the processes described herein. These include, without limitation, hypochlorite and other hypohalite compounds; iodine and other halogens; chlorite, chlorate, perchlorate, and other analogous halogen compounds; permanganate salts; ammonium cerium(IV) nitrate and related cerium(IV) compounds; hexavalent chromium compounds such as chromic and dichromic acids; chromium trioxide, pyridinium chlorochromate (PCC), and chromate/ dichromate compounds; peroxide compounds, including organic peroxide compounds; Tollen's reagent; sulfoxides; persulfuric acid; ozone; and osmium tetroxide ($OsO_4$).

Moreover, while the preferred process described herein is a three step process which utilizes nitric acid in the first step and hydrochloric acid in the second step, various other acids may be utilized in various embodiments of this process. These acids include, without limitation, hydrobromic acid, hydrochloric acid, hydroiodic acid, nitric acid, sulfuric acid, perchloric acid, boric acid, carbonic acid, chloric acid, hydrofluoric acid, phosphoric acid, and pyrophosphoric acid.

Furthermore, while the temperatures and durations of the cleaning steps noted herein represent a preferred embodiment of the processes described herein, one skilled in the art will appreciate that these temperatures and durations may be modified. Such modifications may be based, for example, on the particular chemistry of the plating bath and the nature of the contaminants found therein.

Moreover, while the processes disclosed herein have been described primarily with respect to their use in cleaning metal plating tanks, it will be appreciated that these methods may be used more broadly to clean any components of the plating system, including, without limitation, the plating chemicals tank, the plating chamber, the recirculation lines, the filters, and the fluid delivery lines. It will also be appreciated that the methods described herein may be utilized to remove metal contaminants from other tanks, systems and devices, whether or not they are used in metal plating. These methods may also be used to remove metal contaminants from various surfaces.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A method for removing metal deposits from a tank, comprising:

exposing the tank to a metal plating solution, thereby forming metal deposits on a surface of the tank; and removing the metal deposits through a process comprising (a) exposing the tank to a first solution containing a first acid; and (b) exposing the tank to a second solution containing a second acid and a first oxidizing agent, wherein the first and second solutions have different compositions.

2. The method of claim 1, further comprising:

exposing the tank to a first and second aqueous rinse, wherein the first aqueous rinse occurs before the tank is exposed to the first solution, and wherein the second aqueous rinse occurs after the tank is exposed to the first solution.

3. The method of claim 1, further comprising:

exposing the tank to a second oxidizing agent.

4. The method of claim 1, wherein the first acid is nitric acid.

5. The method of claim 1, wherein the second acid is hydrochloric acid.

6. The method of claim 1, wherein the first oxidizing agent is a peroxide.

7. The method of claim 3, wherein the second oxidizing agent is a peroxide.

8. The method of claim 3, wherein the first and second oxidizing agents are hydrogen peroxide.

9. The method of claim 3, further comprising rinsing the tank with water after exposing the tank to the second oxidizing agent.

10. The method of claim 6, wherein the first oxidizing agent is hydrogen peroxide.

11. A method for removing metal plating solution deposits from a component of a metal plating system, comprising:

exposing the component to a metal plating solution, thereby forming metal deposits on the component; and removing the metal deposits through a process comprising (a) subjecting the component to a first aqueous rinse, (b) exposing the component to a first solution comprising a first acid, (c) exposing the component to a second solution comprising a second acid and a first oxidizing agent, wherein the first and second acids are different, and wherein the first and second solutions have different compositions, (e) subjecting the component to a second aqueous rinse, and (f) exposing the component to a third solution comprising a second oxidizing agent.

12. The method of claim 11, wherein the second acid is HCl, and wherein the first acid is $HNO_3$.

13. The method of claim 11, wherein the first and second oxidizing agents comprise hydrogen peroxide.

14. The method of claim 11, further comprising rinsing the component with water after exposing the tank to the first acid and before exposing the component to the second acid.

15. The method of claim 12, wherein the concentration of HCl in the second solution is within the range of about 1.2M to about 4.8M.

16. The method of claim 12, further comprising heating the first solution.

17. The method of claim 13, wherein the concentration of hydrogen peroxide in the second solution is equivalent to that obtained by diluting 30% weight percent hydrogen peroxide in water to obtain a volumetric ratio of hydrogen peroxide to water within the range of 10:1000 to 400:1000.

18. The method of claim 13, wherein the concentration of hydrogen peroxide in the third solution is equivalent to that obtained by diluting 30% weight percent hydrogen peroxide in water to obtain a volumetric ratio of hydrogen peroxide to water within the range of 200:1000 to 600:1000.

19. A method for removing metal deposits from a metal plating tank, comprising:

exposing the tank to a metal plating solution, thereby forming metal deposits on a surface of the tank; and removing the metal deposits through a process comprising (a) subjecting the tank to a first aqueous rinse, (b) exposing the tank to a first solution comprising nitric acid, (c) subjecting the tank to a second aqueous rinse, (d) exposing the tank to a second solution comprising hydrochloric acid and hydrogen peroxide, wherein the first and second solutions have different compositions, (e) subjecting the tank to a third aqueous rinse, (f) exposing the tank to a third solution comprising hydrogen peroxide, and (g) subjecting the tank to a fourth aqueous rinse.

* * * * *